US010109191B2

(12) United States Patent
Bills et al.

(10) Patent No.: US 10,109,191 B2
(45) Date of Patent: Oct. 23, 2018

(54) METHOD OF QUICKLY DETECTING ROAD DISTRESS

(71) Applicant: INTERNATIONAL BUSINESS MACHINES CORPORATION, Armonk, NY (US)

(72) Inventors: Tierra Bills, Nairobi (KE); Reginald Bryant, Nairobi (KE); Michiaki Tatsubori, Nairobi (KE); Aisha Walcott, Nairobi (KE)

(73) Assignee: International Business Machines Corporation, Armonk, NY (US)

( * ) Notice: Subject to any disclaimer, the term of this patent is extended or adjusted under 35 U.S.C. 154(b) by 117 days.

(21) Appl. No.: 15/040,246

(22) Filed: Feb. 10, 2016

(65) Prior Publication Data

US 2017/0229012 A1 Aug. 10, 2017

(51) Int. Cl.
*G08G 1/00* (2006.01)
*G08G 1/0967* (2006.01)

(52) U.S. Cl.
CPC ..... *G08G 1/0967* (2013.01)

(58) Field of Classification Search
CPC ..... G08G 1/0967
USPC ..... 340/901–905, 435, 436
See application file for complete search history.

(56) References Cited

U.S. PATENT DOCUMENTS

| | | | | |
|---|---|---|---|---|
| 7,562,563 | B2 | 7/2009 | Wee | |
| 8,818,704 | B2 | 8/2014 | Lee | |
| 2005/0065711 | A1 | 3/2005 | Dahlgren | |
| 2010/0019964 | A1 | 1/2010 | Huang | |
| 2011/0140916 | A1 | 6/2011 | Kao | |
| 2012/0083995 | A1 * | 4/2012 | Vorona | G08G 1/0104 701/119 |
| 2012/0203428 | A1 | 8/2012 | Choi | |
| 2013/0325344 | A1 | 12/2013 | Yester | |
| 2014/0355839 | A1 | 12/2014 | Bridgers et al. | |
| 2015/0081444 | A1 | 3/2015 | Hoffberg | |

FOREIGN PATENT DOCUMENTS

| | | |
|---|---|---|
| WO | WO2010040403 | 4/2010 |

OTHER PUBLICATIONS

NPL for-YOR8-2015-0136-pavement_condition_monitoring_with_cv_data_2.pdf.

* cited by examiner

*Primary Examiner* — Daryl Pope
(74) *Attorney, Agent, or Firm* — Eyal Gilboa; Otterstedt, Ellenbogen & Kammer, LLP

(57) ABSTRACT

In various embodiments, the invention involves methods and systems suitable for roadway monitoring, mapping, and maintenance. The probability of a road distress is calculated by combining various sources of data, and automatic alerts are generated to request mobilization of a road repair resource. Various methods are included to increase the accuracy of the probability calculations.

20 Claims, 5 Drawing Sheets

METHOD OF QUICKLY DETECTING ROAD DISTRESS

FIELD OF THE INVENTION

In embodiments, the technical field of the invention is systems and methods for roadway monitoring, mapping, and maintenance.

BACKGROUND

Road distresses such as potholes and speed bumps are numerous and ubiquitous, especially in emerging countries. They may appear unexpectedly and are often the result of poor road maintenance. Intelligent transportation system (ITS) technologies like traffic predictions and simulations can be significantly negatively impacted if the existence of road distresses is ignored.

A method is desired to automate detection of certain road distresses given various readily available information such as road graphs, proven car sensor data (accelerometer and GPS, for example), and traffic flow information. Such a system would enable road maintenance crews and traffic operators to locate road distresses and to improve models for ITS.

A variety of efforts have been made to deal with road distresses, generally with limited success. For example, pothole detection using accelerometer sensors are very ineffective, as driver decisions and maneuvering cause most potholes to be avoided.

SUMMARY OF THE INVENTION

In an aspect is a method for determining the location of a road distress, comprising: measuring, by a mobile sensor, a distress data for a road section, wherein the distress data comprises a distress time component and a distress action component; identifying a relevant traffic data for the road section, the relevant traffic data comprising a traffic time component that corresponds to the distress time component; calculating a probability of a road distress on the road section based on the distress data and relevant traffic data; and generating an alert identifying the road section when the probability of a road distress exceeds a predetermined threshold probability. In embodiments:

the distress data pertains to a first lane in the road section, and wherein the traffic data pertains to a second lane in the road section, the first lane being adjacent to the second lane;

the mobile sensor is integral with a vehicle, or wherein the mobile sensor is integral with a mobile device, the mobile device disposed in the vehicle;

the method further comprises communicating the distress data to a remote server, via a network, and further comprising communicating the alert via a network;

the relevant traffic data is identified from a plurality of traffic data for the road section, wherein the plurality of traffic data is indexed by a traffic time component;

the relevant traffic data is identified from a plurality of traffic data for the road section, wherein the plurality of traffic data is indexed by a traffic time component, and wherein the method further comprises receiving, by the remote server via a network, the plurality of traffic data;

the distress data further comprises a distress lane indicator, and wherein the traffic data further comprises a traffic lane indicator;

the distress data further comprises a distress lane indicator and a distress direction component, and wherein the traffic data further comprises a traffic lane indicator and a traffic direction component;

the probability is determined by a remote server, and wherein the remote server receives a plurality of distress data from the mobile sensor, and wherein the method further comprises identifying a relevant distress action in the distress data.

the distress action component is selected from a maneuvering movement, an acceleration, and a deceleration;

the alert is configured to initiate a road distress avoidance measure in a vehicle;

the alert is a machine-readable instruction configured to initiate a road distress avoidance measure in a vehicle when the vehicle enters the identified road section, and wherein the method further comprises adding the alert to a database of alerts;

the distress data pertains to a first lane in the road section, and wherein the traffic data pertains to a second lane in the road section, the first lane being adjacent to the second lane, and wherein the relevant traffic data is identified from a plurality of traffic data for the road section, wherein the plurality of traffic data is indexed by a traffic time component;

the distress data pertains to a first lane in the road section, and wherein the traffic data pertains to a second lane in the road section, the first lane being adjacent to the second lane, and wherein the mobile sensor is integral with a vehicle, or wherein the mobile sensor is integral with a mobile device, the mobile device disposed in the vehicle; and the mobile sensor is integral with a vehicle, or wherein the mobile sensor is integral with a mobile device, the mobile device disposed in the vehicle, and wherein the relevant traffic data is identified from a plurality of traffic data for the road section, wherein the plurality of traffic data is indexed by a traffic time component.

In another aspect is a computer system for determining the location of a road distress, comprising: a processor; a memory coupled to the processor, the memory configured to store program instructions executable by the processor to cause the computer system to: receive, from a mobile sensor, a distress data for a road section, wherein the distress data comprises a distress time component and a distress action component; identify a relevant traffic data for the road section, the relevant traffic data comprising a traffic time component that corresponds to the distress time component; calculate a probability of a road distress on the road section based on the distress data and relevant traffic data; and generate an alert identifying the road section when the probability of a road distress exceeds a predetermined threshold probability. In embodiments:

the distress data pertains to a first lane in the road section, and wherein the traffic data pertains to a second lane in the road section, the first lane being adjacent to the second lane, and wherein the relevant traffic data is identified from a plurality of traffic data for the road section, wherein the plurality of traffic data is indexed by a traffic time component;

the distress data pertains to a first lane in the road section, and wherein the traffic data pertains to a second lane in the road section, the first lane being adjacent to the second lane, and wherein the mobile sensor is integral with a vehicle, or wherein the mobile sensor is integral with a mobile device, the mobile device disposed in the vehicle;

the alert is configured to initiate a road distress avoidance measure in a vehicle;

the alert is a machine-readable instruction configured to initiate a road distress avoidance measure in a vehicle when the vehicle enters the identified road section, and wherein the method further comprises adding the alert to a database of alerts; and the mobile sensor is integral with a vehicle, or wherein the mobile sensor is integral with a mobile device, the mobile device disposed in the vehicle, and wherein the relevant traffic data is identified from a plurality of traffic data for the road section, wherein the plurality of traffic data is indexed by a traffic time component.

In an aspect is a method for managing road repair resources, the method comprising: calculating a probability of a road distress in a road section by combining sensor data from a mobile sensor with relevant traffic data; and automatically alerting a road repair resource to request repair of the road section when the calculated probability of a road distress exceeds a predetermined threshold probability. In embodiments:

the sensor data pertains to a first lane in the road section, and wherein the traffic data pertains to a second lane in the road section, the first lane being adjacent to the second lane;

the distress data pertains to a first lane in the road section, and wherein the traffic data pertains to a second lane in the road section, the first lane being adjacent to the second lane, and wherein the relevant traffic data is identified from a plurality of traffic data for the road section, wherein the plurality of traffic data is indexed by a traffic time component; and the mobile sensor is integral with a vehicle, or wherein the mobile sensor is integral with a mobile device, the mobile device disposed in the vehicle, and wherein the relevant traffic data is identified from a plurality of traffic data for the road section, wherein the plurality of traffic data is indexed by a traffic time component.

These and other aspects of the invention will be apparent to one of skill in the art from the description provided herein, including the examples and claims.

DETAILED DESCRIPTION OF VARIOUS EMBODIMENTS

Figure 1:
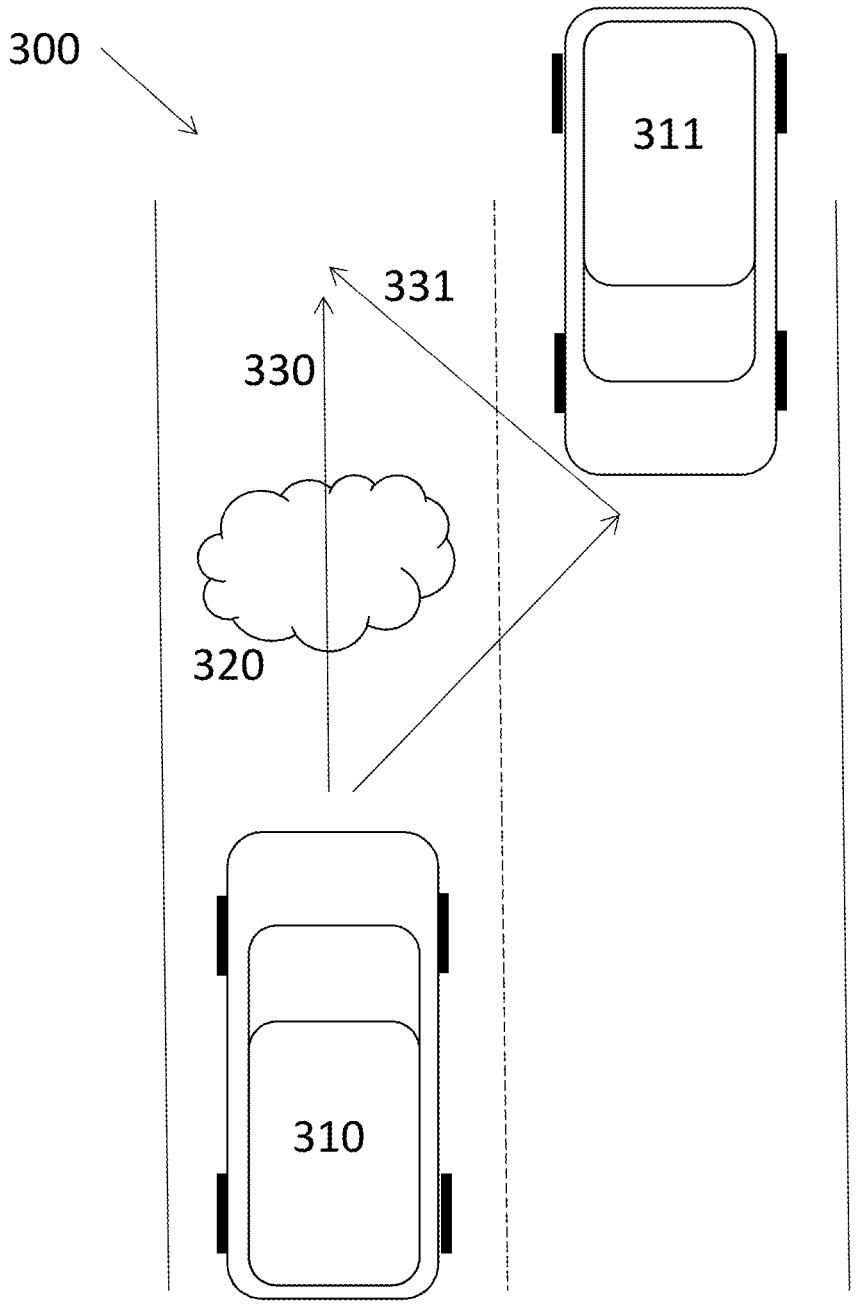
FIG. 1 illustrates certain vehicle options when encountering a road distress.

The methods disclosed herein involve a computer system comprising a processor and a memory. The computer system may be, for example, a remote server with access to a computer network suitable for transmitting and receiving data. The computer system may include a number of auxiliary devices such as input/output devices (keyboards, mouse, monitor, I/O ports, etc.), communications and networking modules, additional storage modules, and the like. The computer system may be configured for direct use by a user (i.e., with a user interface) or may be configured to interact with devices (e.g., terminals, etc.) that provide the user interface.

In an aspect is a method for determining the location of a road distress. The term "road distress" (or simply "distress") as used herein is meant to include potholes, holes or swells caused by water (e.g., sinkholes), holes or swells caused by vegetation (e.g., tree roots, etc.), holes or swells caused by road damage, obstructions (e.g., rocks, debris, etc.), and the like. In embodiments road distresses cause changes to driver behaviour, such changes including reducing speed, manoeuvring to avoid the distress (in whole or in part), etc. The size of a road distress, which may be large or small and which may be determined by the methods disclosed, is not a critical aspect as much as the change that the distress causes on changing driver behaviour. Thus even physically small distresses may be of high importance where a distress causes large and/or consistent changes to driver behaviour.

The location of a road distress (either generally, as in the section of roadway that contains the road distress, and/or specifically, as in the exact coordinates of a road distress) is important as data for a variety of uses by a variety of actors. Those in charge of road maintenance require such data in order to initiate repair of the distress, issue alerts to motorists, track road wear and tear, determine road quality (initial and instantaneous), etc. Motorists can use such information in selecting routes, for example. Managers and politicians can use such information in planning road works, and selecting road construction techniques. It will be appreciated that road distresses may exist anywhere along or aside a roadway—e.g., within a lane, straddling two or more lanes, on a road shoulder, at a road median, etc.

The methods disclosed herein enable determination of the location of a road distress, where such information is determined to the greatest degree of accuracy possible. Accuracy in the location of a particular road distress may be improved over time after an initial determination of the location, particularly as additional information is gathered and combined with the initial information. In embodiments, the invention provides a road distress location accurate to within a road section (such may also be referred to herein as a "general road distress location"). For example, an alert may be generated that a specific road section, which may be identified by a Road ID number as described herein, contains a road distress. In embodiments the invention provides a road distress location accurate to within a relative or absolute distance (such may also be referred to herein as a "specific road distress location"). For example, the location may be an absolute distance and may be accurate to within the range of 0.1-10 meters, or 0.1-5 meters, or 0.1-1 meters, or may be accurate to less than or equal to 10, 8, 5, 3, 2, 1, 0.5, 0.3, or 0.1 meters. For example, the location may be a relative distance and may be accurate to within the range of 1-10 times, or 1-5 times, or 1-3 times the diameter of the road distress, or may be accurate to less than or equal to 10, 8, 5, 3, 2, 1, 0.5, 0.3, or 0.1 times the diameter of the distress. In the above measurements, distances may be measured from the centre point of a distress (or from the centre point of a circle that surrounds the entire distress, wherein such circle also provides a "diameter" of the distress), or the outermost edge point of a distress, as appropriate or desired. It will be appreciated that locations may be refined as additional data about a distress are collected and integrated into the calculations. For example, an initial detection of a road distress via data from a single vehicle and associated traffic data may provide a first location (with a first accuracy as to the true location of the distress). Where a second vehicle encounters the same distress and, such encounter provides data to the disclosed system/method, a second location may be determined with a second accuracy as to the true location of the distress. Alternatively or in addition the second location may be determined based on additional traffic data (as opposed to data from an additional vehicle encounter) as described herein. The second location may be more accurate than the first location, such as at least 50, 60, 70, 80, 90, or 95% more accurate.

In embodiments, the method for determining a road distress location involves measuring, by a mobile sensor, a distress data for a road section. A "road section," as the term is used herein, refers to a predetermined length and location of a road. In embodiments, the roads in a geographic region (e.g., a city, village, suburb, or other region) are predefined into sections, which sections may be identifiable on a map of the roads in the region. Each road section may be assigned a unique identifier (a "Road ID") such as an alphanumeric value or the like, and the Road ID can be tabulated with the corresponding road lengths and locations.

A road section length may be of any suitable value for the context, such as a length in the range of 10-1000 meters, or such as a length less than or equal to 1000, 800, 500, 300, 100, 50, 25, or 10 meters, or a length greater than or equal to 10, 25, 50, 100, 300, 500, 800, or 1000 meters. The surrounding environs may influence the chosen road section length—e.g., in a region of high population density such as a city centre, the road section may be smaller such as less than 100 meters, whereas in rural roads the road section length may be bigger such as 1000 meters or more. In embodiments, all road sections in a common geographical region have a single standardized length, although in other embodiments the length may vary from road section to road section.

The road section location is determined by, for example, the GPS coordinates of one or more features of the road section. For example, the road section location may be assigned based on the GPS coordinates of the midpoint (both in length and in width, or in length only) of the road section. Alternatively, the road section location may be assigned based on the GPS coordinates of the two endpoints of the road section (e.g., a road that extends from a first GPS coordinates to a second GPS coordinates). Other methods for identifying a road section location are possible and are within the scope of the invention.

In embodiments, the distress data comprises a distress time component and a distress action component. The distress time component is a time marker that is measured at the time that a vehicle encounters a road distress. Such time may be obtained, for example, from an internal clock on the mobile sensor. Alternatively or in addition, the distress time component may be obtained from an external source such as a cellular signal or a GPS signal. It may be helpful to use multiple sources in order to verify or increase the accuracy of the distress time component. Accuracy of the distress time component is important because the time component is used to correlate the distress action with traffic data, as described herein.

The distress action component is data pertaining to an action by the vehicle indicative of a road distress. In embodiments the vehicle action corresponds to an action from a list of possible actions. The list of possible actions may include, for example, accelerometer signals indicative of an encounter with a depression (e.g., a pothole) or a swell (e.g., a protruding tree root), accelerometer signals indicative of an avoidance maneuver, accelerometer signals indicative of a sudden acceleration or deceleration, and the like. Alternatively, in embodiments, rather than comparing the vehicle action data to a list of possible actions, the data (e.g., accelerometer data or the like from the mobile sensor) may be analysed by computer algorithms to identify actions that are indicative of a road distress. In embodiments, the distress action component is selected from a movement (e.g., an avoidance maneuver or a distress encounter) and an acceleration. The computer algorithm used by the computer system may be an adaptive algorithm that improves at identifying distress actions as data is processed from multiple mobile sensors over time. When a distress action is identified (i.e., when data is collected by a mobile sensor that indicates an encounter with a road distress), the system then marks the collected data with the associated distress time component (i.e., the time at which the mobile sensor recorded a distress action). The combination of the distress action data (i.e., collected data indicating a road distress encounter) and the distress time component form a distress data, which is communicated by the mobile sensor to a storage medium either on board the vehicle or at a remote location, as described herein.

For example, a distress action may be a sudden change in the z-component of three dimensional continuously-acquired accelerometer data, indicative of a vehicle encountering a pothole and driving through the pothole. Alternatively, the distress action may involve a sudden change in the x- or y-component of three-dimensional continuously-acquire accelerometer data, followed by a sudden reversion back to the original trajectory. Such data may be indicative of a vehicle taking evasive action due to the presence of a pothole or other obstruction. Typically, the mobile sensor (described further herein) will be continuously acquiring data at any time that the vehicle is in operation (either in actual movement or where the vehicle's engine/motor is operating, even where the vehicle is not itself moving). In embodiments, all data is transmitted (either in real time, or with a delay, or as batches of data to the computer system for analysis. In other embodiments, the mobile sensor is associated with a processor and machine-readable instructions suitable to process all acquired data. In such embodiments the machine-readable instructions will be suitable to identify relevant data (i.e., distress data) from non-relevant data (i.e., data acquired while the vehicle is not encountering any road distresses), and the mobile sensor will then transmit only distress data to the computer system.

The distress data is obtained for a road section. In embodiments, the distress data is assigned to the Road ID within which the distress action data was recorded by the mobile sensor. In embodiments, the distress data is assigned a general road distress location—this is the road section location pertaining to the road section in which the distress action data was recorded by the mobile sensor. In embodiments, the distress data is assigned a specific road distress location—this is, for example, GPS coordinates of the location of the road distress (e.g., the GPS coordinates of the vehicle at the time that the mobile sensor records a distress action). This is particularly useful where a road section is large (e.g., 1000 meters)—the specific road distress location will assist rapid identification of the distress. In embodiments, a road distress may exist at the intersection between two road sections or may be large enough to exist in two road sections simultaneously. In such embodiments, where possible, only one road section will be identified (e.g., the road section where the road distress is first encountered). Alternatively the specific road distress location may be used in such instances.

Assignment of the road distress location (whether general or specific) may be accomplished in a variety of ways. In embodiments, the mobile sensor or an ancillary component thereof records the GPS coordinates (or another measure of geo-location, such as triangulation of a plurality of cellular signals, or a combination thereof in order to improve accuracy of the location data) at the time that the distress action occurs. This location data is then attached to the distress action component as part of the distress data. The GPS coordinates may then be used directly as the specific road distress location. Alternatively, the road distress location may be converted to a Road ID (i.e., a general road distress location) by assigning the Road ID from the road section that encompasses the GPS coordinates from the measured road distress location. Such assignment of the Road ID may be carried out by the computer system after receiving the distress data from the mobile sensor, or may be carried out locally by the mobile sensor and ancillary components.

In embodiments, a further component of the distress data is a distress direction component. This is data pertaining to the direction of travel of the mobile sensor at the time that the sensor encounters a road distress. The direction of travel may be represented by a number heading (i.e., a number in the range 0-359°, with 0° representing travel in a northerly direction). Alternatively, since any specific road section typically allows for travel in only two directions, the distress direction component can be a binary value to indicate which of the two possible directions the mobile sensor was traveling. The distress direction component may be determined, for example, using historical coordinate values from the mobile sensor that are optionally compared with a database of values indicating the possible directions of travel for any particular road section. Alternatively the distress direction component may be determined from a compass or other integrated direction-indicating sensor. In embodiments, in addition to providing the direction of travel, the distress direction component may further comprise a distress lane indicator, which provides the specific lane on a multi-lane road that is used by the mobile sensor at the time that the sensor encounters a road distress. The distress lane indicator is option and may be available only when high resolution sensors are in use.

Where data is continuously acquired by the mobile sensor and analysed to identify road distresses by the computer system (i.e., server), it may be necessary to tag all acquired mobile sensor data with associated GPS, time, and distress direction data, as well as any other appropriate data. Alternatively, where the mobile sensor is part of a device containing a process and instructions capable of processing the acquired data, such associated data (GPS, time, etc.) may be tagged only if and when the device identifies a distress action, priori to sending such data to the server.

The distress action is a measurement taken by a mobile sensor. Examples of mobile sensors include an accelerometer, gyroscope, force meter, inclinometer, vibration meter, and the like, or combinations thereof. It will be appreciated that such sensors may exist in a wide variety of embodiments, and any appropriate embodiment of such sensors is within the scope of the invention. For example, an accelerometer may be of any suitable type, such as piezoelectric devices or the like. Furthermore, as an alternative to measuring acceleration, the device may measure 3-dimensional coordinates and identify changes in velocity via changes in the coordinates over time. It will be appreciated that additional methods for measuring suitable data, including future developed methods, will be within the scope of the invention. Furthermore, a plurality of mobile sensors may be used in conjunction, and the data collected may be combined such that the distress action is a data set.

In embodiments the mobile sensor is located within or on a vehicle. For example, the mobile sensor is integral with a vehicle—i.e., it is built into the vehicle upon manufacture or is installed in the vehicle post-manufacture. In embodiments the mobile sensor is integral with a mobile device, and the mobile device is disposed in the vehicle. Examples of mobile devices are multipurpose devices such as cellular phones, laptops, and tablets, and single purpose devices such as dedicated sensor devices. Mobile phone apps may be used to collect and even to transmit the sensor information. Alternatively, the mobile sensor may be a sensor in a vehicle that is nominally used for other purposes—e.g., an accelerometer nominally used in the airbag system of a vehicle. Other on-board sensors, particularly in modern vehicles, are also suitable. A built-in interface such as that commonly used to do on-board diagnostics or the like may also be used to carry out the described methods.

The mobile sensor contains or is integrated with a device that contains a communications component to enable the mobile sensor to communicate sensor information via a communications network. Any suitable mobile network communications scheme may be used. The network may be, for example, a cellular network (e.g., a GSM network or the like). Alternatively or in addition, the communications may be via RF signals such as WiFi or the like. The mobile sensor, or the device within which the mobile sensor is integrated, will have appropriate circuitry and components to enable such communication. Data transmitted via the network can be raw data or processed data such as Fourier Transforms of the raw data, or the like.

In embodiments the mobile sensor, or the device within which the mobile sensor is integrated, has resident memory for storing data. Such storage may be used, for example, where the mobile sensor is out of range of a communications network. When the device returns to network range, the stored data can then be sent via the network. The stored data can further be used for the purpose of verifying records received at a remote location via the communications network. In embodiments, the mobile sensor has no resident memory and communicates all data in real time.

In embodiments the mobile sensor, or the device within which the mobile sensor is integrated, transmits data (e.g., distress data) to the computer system via the communications network. In embodiments, the mobile sensor measures and transmits sensor data in real time, and the time stamp of transmission of a distress action is used as the distress time component. In other embodiments, the mobile sensor measures and stores bulk data including both sensor data and time data. Later uploading and analysis of such bulk data is able to identify distress actions (and their associated distress time components).

Throughout this disclosure, a vehicle containing a mobile sensor, a communications component, and optional memory as described herein is referred to as a "sensor vehicle". The sensor vehicle encounters a road distress, captures distress data, and provides the distress data to the computer systems as described herein. The mobile sensor, communications component, and optional memory component (and related circuitry and components such as an optional power source, etc.) may be collectively referred to herein as a "sensor package". The sensor package may be wholly self-contained and therefore able to be moved between vehicles. Alternatively the sensor package may be integral and fixed with a specific vehicle. Hybrid embodiments are also possible, where certain components are integral and fixed (e.g., a power source and communications component is fixed in a vehicle) and other components are not fixed (e.g., a sensor and memory), and there exists a suitable interface (e.g., USB or the like) between the fixed and non-fixed components.

The following disclosure regarding traffic data assumes that a distress data has been received by a computer system from a sensor vehicle. In addition to such distress data, a computer system of the invention receives traffic data. The term "traffic data" refers to data pertaining to the movement of one or more vehicles other than the sensor vehicle reporting the distress data. Traffic data may be obtained from a variety of sources singly or in combination. Examples of such sources include video data from webcams, traffic cams, television cameras, security cameras, and the like. Further examples of such sources include sensor data such as from one or more sensor packages in vehicles travelling along roadways (excluding the distress data from the sensor package reporting the distress data), road sensors (i.e., sensors at the side of the road or built into a road), and the like. In embodiments, the traffic data is obtained from a sensor package on a vehicle outfitted according to the current invention. In embodiments, the traffic data is obtained from sensors on smart phones and other commonly carried electronic devices. Combinations of the above-mentioned sources of data are also suitable. Other sources of traffic data are possible, as will be appreciated by one of skill in the art.

In embodiments, traffic data comprises a traffic time component, a traffic movement component, and a traffic location component. The traffic movement component is data about the movement of vehicle(s). The movement of the vehicles may include vehicle velocity, acceleration or deceleration, emergency manoeuvres, and the like. Such data may be for a single vehicle or for a plurality of vehicles. In the case of such data representing a plurality of vehicles, the data may be averaged across the represented vehicles, or tabulated such that the individual vehicle data remains. The traffic movement component may include one or more vector(s) assigned to a vehicle. The traffic movement data can be analysed by a computer algorithm to determine whether there is unusual traffic movement—e.g., manoeuvring by a vehicle, sudden acceleration or deceleration, etc. In embodiments, vehicle behaviour simulations may be used to determine movements that are common for vehicles carrying out specific actions such as avoidance of another vehicle or a road distress. Such simulations may provide comparative data suitable for analysing traffic movement data.

The traffic location component may be a general location (i.e., the Road ID upon which the vehicles involved in the movement were located), or a specific location (e.g., GPS coordinates, or some other measure of the location of a specific vehicle(s) movements).

The traffic time component is a time stamp pertaining to a traffic movement. As mentioned herein, this may be a time stamp from a single source (e.g., the source of the traffic movement measurement or the like), or an average from multiple time sources in order to increase accuracy and/or provide consistency.

In embodiments, the traffic data may further comprise a traffic direction component. This is data pertaining to the direction of travel of the traffic at the time that the traffic movement component is measured. As with the distress direction component, the direction of travel may be represented by a number heading (i.e., a number in the range 0-359°, with 0° representing travel in a northerly direction). Alternatively, the traffic direction component can be a binary value to indicate which of the two possible directions the mobile sensor was traveling. The traffic direction component may be determined, for example, using historical coordinate values from sensors or cameras that are optionally compared with a database of values indicating the possible directions of travel for any particular road section. In embodiments, in addition to providing the direction of travel, the traffic direction component may further comprise a traffic lane indicator, which provides the specific lane on a multi-lane road that is used by the vehicle(s) at the time that the traffic movement is measured. The traffic lane indicator is option and may be available only when high-resolution sensors are in use.

The sensor vehicle itself may further include one or more sensors that help to provide accurate traffic data. For example, the sensor vehicle (e.g., as part of the sensor package or otherwise) may contain infrared or other sensors that can be used to detect vehicles in the vicinity of the sensor. Such sensors may be placed around the vehicle as appropriate, and may communicate the sensor information to the computer system along with distress data as described. Such communication may also be separate from the distress data if desired.

From the traffic data received, the computer system identifies one or more relevant traffic data. A relevant traffic data is traffic data that is relevant to the distress data received from the sensor vehicle. The relevancy of a traffic data is determined by relevancy in both location and time. Thus, for a traffic data to be relevant to a distress data, the traffic time component will correspond (within a margin) to the distress time component for the specific distress data. For example, the traffic time component and the distress time component will be within the range of each other of 0-10 seconds, 0-5 seconds, or 0-3 seconds, or there will exist a difference of equal to or less than 10, 8, 5, 3, 2, 1, or 0.5 seconds between the time components. Also, for a traffic data to be relevant to a distress data, the traffic location will correspond (within a margin) to the road distress location. For example, the general traffic location and the general road distress location will be the same Road ID or, for relatively small road sections, the Road IDs may indicate adjacent road sections. As an alternative example, the GPS coordinates of a specific traffic location and the GPS coordinates of the specific road distress location will indicate similarity of location—e.g., the coordinates indicate a distance between the road distress location and the traffic location in the range of 0.5-15 meters, or 0.5-10 meters, or 0.5-5 meters, or a distance between that is less than or equal to 15, 10, 5, 3, 2, or 1 meters.

Identifying a relevant traffic data may involve, in embodiments, analysing several traffic data from different traffic times and/or different traffic locations, and using weighting factors for the various variables to determine the "most" relevant traffic data to a particular distress data. Suitable weighting factors will be easily determined through routine experimentation and modelling. In some embodiments, traffic with a traffic direction component that is opposite to the distress direction component may be weighted more heavily than where the components are the same—this is an indication that the traffic movement pertains to vehicles traveling in an opposite direction compared with the sensor vehicle. Furthermore, in embodiments, traffic from an adjacent lane (as indicated by comparing the distress lane indicator with the traffic lane indicator) may be weighted more heavily than non-adjacent lanes. In some embodiments, more than one traffic data may be identified as relevant and may be used in the methods described.

In embodiments, the methods comprise calculating a probability of a road distress (also referred to herein as a "distress probability") on a road section based on distress data and relevant traffic data. A distress probability score can be assigned, for example, to the Road ID that is identified in distress data. Alternatively or in addition, a distress probability score can be assigned to a specific road distress location. The probability score ranges from 0-1 (where 0=no probability exists, 1=100% the highest level of certainty exists) and indicates the likelihood based on the acquired/processed data that a road distress is present.

The relevant traffic data can be a plurality of traffic data, with appropriate weighting factors (e.g., heavily weighting adjacent-lane data and data for traffic movements that are very close in time to a distress time). The calculated distress probability can be refined by using a plurality of distress data and/or a plurality of traffic data. Other data such as camera data, historical traffic or distress data, road construction data, data pertaining to the type of road or type of techniques/materials used in constructing or repairing the road, and human input can be used to increase or decrease the calculated probability. In some cases it may be necessary or desirable to reset the probability calculations for a specific Road ID or a specific road distress location, particularly after a repair has been made to a road section or after a temporary obstruction (e.g., a tree branch) has been cleared. This can be done manually or automatically.

The distress probability is calculated by the computer system using appropriate algorithms as described herein. In embodiments, a computer system (e.g., a central server) receives all distress data, traffic data, and additional data, and carries out the probability calculations on such data.

A variety of factors can be used in the algorithm for obtaining a calculated probability. For example, in an embodiment, adjacent-lane traffic data is specifically heavily weighted in order to increase the accuracy of the calculated probability. Thus, for example, the distress data pertains to a first lane in the road section, and the traffic data pertains to a second lane in the road section, the first lane being adjacent to the second lane. It should be appreciated that movement of vehicles in a lane is more likely to be influential on the behaviour of vehicles in immediately adjacent lanes, hence the rationale for heavily weighting adjacent-lane traffic data. Furthermore, if there is a free adjacent lane, there is a higher probability that a vehicle will avoid a road distress by temporarily maneuvering into the free lane. Accordingly primarily lane data (i.e., data collected by the sensor vehicle) is combined with traffic data (particularly, although not necessarily, adjacent lane data) in order to increase the accuracy of the calculated probability of a road distress in a location. Furthermore, traffic data collected over time and historical data can be used to create statistical models of traffic through road sections, which statistical models can be used to increase the accuracy of analysis of distress actions.

The term "lane" in this disclosure, unless indicated otherwise or obvious from the context, is used in the traditional sense and refers to a space on a roadway designated by painted lines, road studs, or another indicator as the case may be, typically running parallel along the direction of travel of the road, and within which vehicles are intended to remain as they travel along the roadway (unless a vehicle is turning, changing lanes, or the like). The term is not meant to be limiting, however, and will be appreciated that some roads (particularly in developing countries, rural areas, etc.) do not contain marked lanes. In such instances the term "lane" is merely intended to denote lateral spaces on a roadway in which vehicles tend to be positioned as they travel along the road, and it will be appreciated that such lateral spaces are not fixed (such as with painted lane markers) and may vary over time and with specific conditions.

In embodiments, the calculated probability of a road distress is compared with a threshold value (e.g., also in the range of 0-1), which threshold value can be set to any desirable value as appropriate for the circumstances. For example, in regions where it is desirable to have early notifications of a possible road distress, the threshold value can be set lower. Where the calculated probability exceeds the threshold value for a general or specific road distress location, any one or more of a number of actions can be automatically triggered. For example, an alert can be generated identifying the road section with an above-threshold probability. The alert can be communicated to one or more stakeholders (e.g., road repair crews, street maintenance managers, etc.), such as via a mobile network, internet, or intranet. In an embodiment, the alert is an SMS sent to recipients suitable for dealing with road distresses. In embodiments, the alert is a pop-up window or another alert that appears on a computer screen of a suitable recipient. It should be stressed that the above actions are automatically carried out, in order to reduce the amount of human activity that is needed in assessing road quality and maintenance. In embodiments, all road distresses can be treated equally, such that the calculated probability is not affected by factors such as the road location and/or Road ID, the number of road distresses in a road section, the number of data points used in the calculations, and other similar factors. In other embodiments any of these or other factors may be weighted more heavily to prioritize certain road distresses over others.

In embodiments, the alert that is generated when the probability of a road distress exceeds a threshold probability is configured to initiate a road distress avoidance measure in a vehicle. For example the alert may be a machine-readable instruction configured to initiate a road distress avoidance measure in a vehicle when the vehicle enters the identified road section. A road distress avoidance measure may be an automatic measure such as automatic steering, breaking, or accelerating that can be carried out by an automatic system of the vehicle receiving the alert. Automatic systems include automatic steering, breaking or accelerating systems that are known in the art and incorporated into modern vehicles. In embodiments the vehicle that receives the alert and executes the road distress avoidance measure is any vehicle that follows (in time) after the initial vehicle (i.e., the vehicle with the sensor that initially detected the road distress and caused the alert to be issued). The methods herein may further comprise adding the alert to a database of alerts, such that a vehicle may query the database to be prepared for known road distresses as the vehicle passes through various road sections. In addition or in the alternative, the alert may be configured to provide an audible or visible alert to a driver in a vehicle, such as a visible alert on a display in the vehicle (e.g., the dashboard, or a heads-up display, or another monitor in the vehicle) or an audible alert to be played for the driver via the vehicle audio system. All of the above actions and other actions that are suitable for the alert may be facilitated by the devices described herein and/or may be suitable for reception/processing/action by components that are incorporated into modern vehicles (e.g., standard communications systems, etc.).

Throughout this specification, various time components are identified and used by the computer systems and methods. It will be appreciated that certain events such as a distress action or a traffic movement occur over a period of time rather than at an instantaneous time. For this reason, comparisons of time components between data may take a variety of formats. For example, an event such as a distress action can be, for the purposes of comparisons with traffic data, represented by a representative time (e.g., the midpoint time between the beginning and end of the distress action data, or the initial time recorded for a distress action, etc.).

As described herein, in embodiments, a device may be mounted in a vehicle to assist in data collection and information display/communication. The device may have a sensor (e.g., accelerometer, a gyroscope, etc.), GPS module, communications module (e.g., a SIM and appropriate circuitry for communication with a cellular network), output module, or any combinations thereof, including a plurality of sensors as desired. For example the output module may be visual (e.g., a display) or audio (e.g., a speaker), or a combination thereof. The device may be mounted in a position so that the output module may be viewed or heard by a user such as a driver of the vehicle. The communications module is configured to relay GPS and/or sensor data to a server, either as unprocessed data or as processed data (e.g., Fourier Transformed data, etc.), and including suitable metadata as desired. The communications module is further configured to receive information from the server. The device is further configured to process information received from the server (such as rendering the information to be displayed) and output the information for the user to receive. Such information may include the location of nearby road distresses, particularly road distresses identified based on data from other vehicles. Such device may also give the user the option (e.g., by requesting confirmation or other user input) to report data or to delete data without reporting the data. The device may be a dedicated device, including a device that is permanently mounted in the vehicle and draws power from the vehicle's power systems (battery, alternator, etc.). Alternatively the device may be a multipurpose device (including, e.g., a mobile phone with a suitable application enabling the functions described herein to be carried out by the phone) including a multipurpose device that is removable from the vehicle and self-contained with respect to power. In some embodiments, certain functions described above may be carried out externally to the device. For example, for vehicles with built in communication systems (e.g., built in cellular modules), the device may interface with such external communications systems in order to carried out the necessary tasks (e.g., communication of data to the server and receipt of information from the server). Also for example, and as described herein, certain data may be obtained from sensors built in to the vehicle such as accelerometer data, GPS data, etc. Again, such data may be relayed to the device so as to be communicated to the server. Appropriate interfaces may be required in order for the device to obtain sensor data from the vehicle, and such interfaces are known in the art.

With reference to FIG. 1, road section 300 is shown. Vehicle 310, traveling in an upwardly directly, encounters road distress 320 (e.g., a pothole). If vehicle is not present, there is a relatively higher probability that vehicle 310 will follow path 331 in order to avoid road distress 320. In such case, any z-axis sensor on vehicle 310 may not register an abnormal event or a sudden change since road distress 320 is avoided. However, the x- and y-axis sensors may register an unusual and rapid deviation from the normal path, followed by an equally rapid return to the initial trajectory. Such actions can be interpreted to show, indirectly, the presence of road distress 320, provided that the actions of vehicle 310 are linked to traffic data that shows the lack of any vehicles in the neighbouring lane. In the case where vehicle 311 is present, and traveling in a downwardly direction as shown (such as when there is oncoming traffic relative to vehicle 310), there is a relatively higher probability that vehicle 310 will follow path 330. The z-axis sensor on vehicle 310 will then register an encounter with road distress 320, showing the road distress directly.

Figure 2:
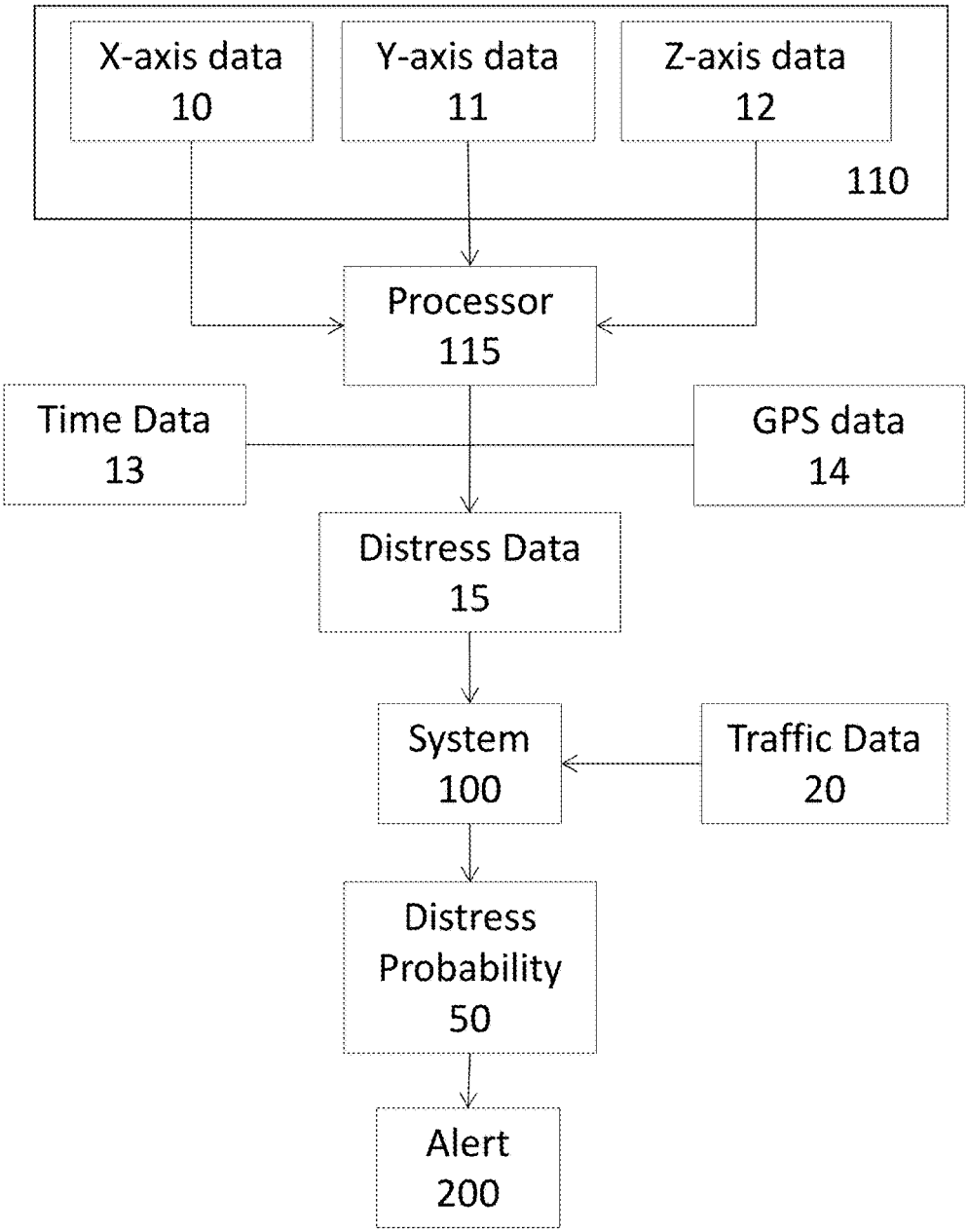
FIG. 2 provides a flow chart for determining an alert according to an embodiment of the invention.

With reference to the embodiment shown in FIG. 2, there is provided a flow chart for data acquisition and transmission in the process of generating an alert. Mobile sensor 110 enables three-dimensional data collection. X-axis data 10, y-axis data 11, and z-axis data 12 are recorded and processed by processor 115 (both mobile sensor 110 and processor 115 are part of a device disposed within a vehicle, not shown in the figure). Processor 115 identifies a distress action from the acquired three-axis data, and then combines such distress action with time data 13 and GPS data 14 in order to prepare distress data 15. Distress data 15 is then transmitted to computer system 100. System 100 further receives traffic data 20, identifies traffic data correlating to distress data 15, and creates distress probability 50. If distress probability 50 exceeds a threshold probability score, system 100 generates alert 200 and transmits the alert to relevant recipient stakeholders.

Figure 3:
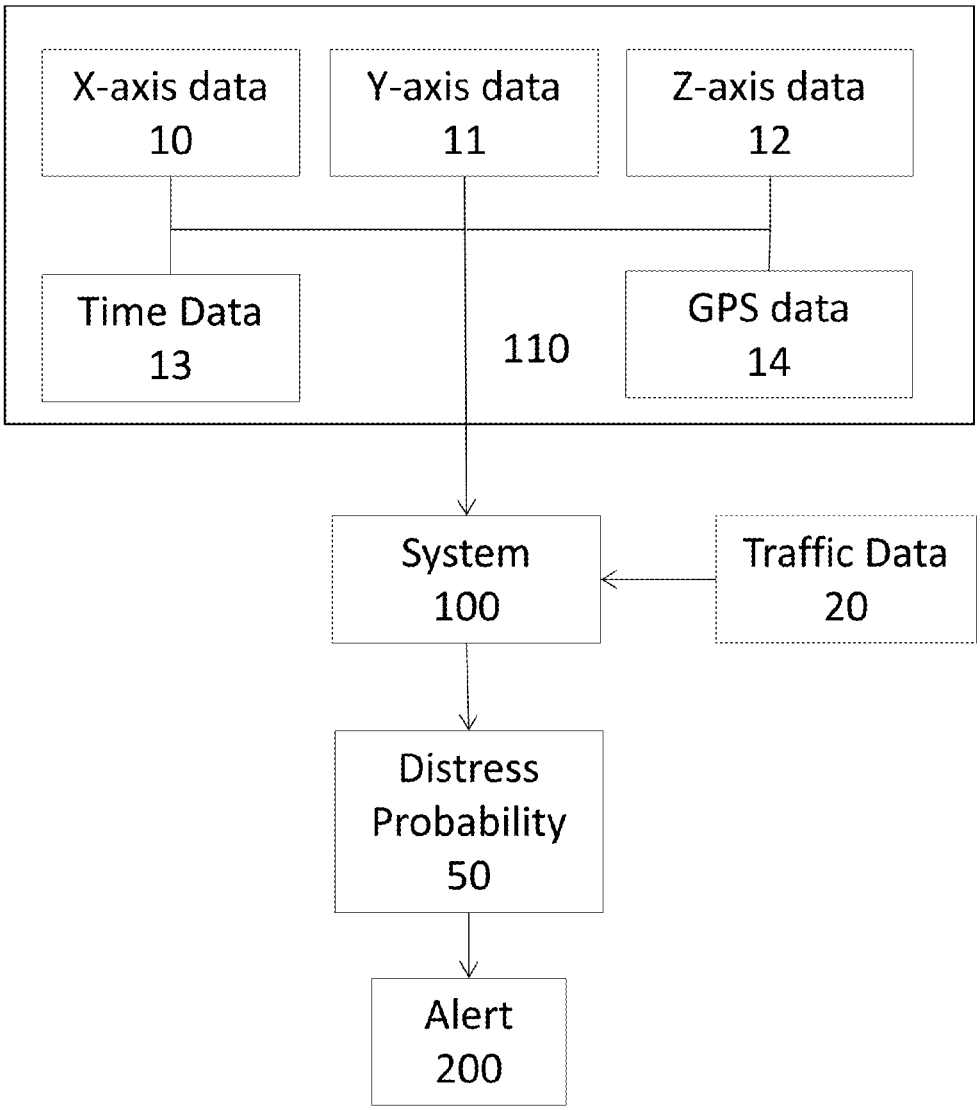
FIG. 3 provides a flow chart for determining an alert according to an embodiment of the invention.

With reference to the embodiment shown in FIG. 3, there is provided a flow chart for data acquisition and transmission in the process of generating an alert. Mobile sensor 110 enables three-dimensional data collection. X-axis data 10, y-axis data 11, and z-axis data 12 are recorded, tagged with time data 13 and GPS data 14, and transmitted to system 100. System 100 also receives traffic data 20, which is data that is indexed by time and location. System 100 analyses all received data, identifies distress actions, and associates such distress action data with the corresponding traffic data. From such inter-linkages, distress probability 50 is generated. If distress probability 50 exceeds a threshold probability score, system 100 generates alert 200 and transmits the alert to relevant recipient stakeholders.

Throughout this disclosure, use of the term "server" is meant to include any computer system containing a processor and memory, and capable of containing or accessing computer instructions suitable for instructing the processor to carry out any of the steps disclosed herein or otherwise necessary to achieve the desired operation. The server may be a traditional server, a desktop computer, a laptop, or in some cases and where appropriate, a tablet or mobile phone. The server may also be a virtual server, wherein the processor and memory are cloud-based—i.e., decentralized processing and storage.

The methods and devices described herein include a memory coupled to the processor. Herein, the memory is a computer-readable non-transitory storage medium or media, which may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Throughout this disclosure, use of the term "or" is inclusive and not exclusive, unless otherwise indicated expressly or by context. Therefore, herein, "A or B" means "A, B, or both," unless expressly indicated otherwise or indicated otherwise by context. Moreover, "and" is both joint and several, unless otherwise indicated expressly or by context. Therefore, herein, "A and B" means "A and B, jointly or severally," unless expressly indicated otherwise or indicated otherwise by context.

It is to be understood that while the invention has been described in conjunction with examples of specific embodiments thereof, that the foregoing description and the examples that follow are intended to illustrate and not limit the scope of the invention. It will be understood by those skilled in the art that various changes may be made and equivalents may be substituted without departing from the scope of the invention, and further that other aspects, advantages and modifications will be apparent to those skilled in the art to which the invention pertains. The pertinent parts of all publications mentioned herein are incorporated by reference. All combinations of the embodiments described herein are intended to be part of the invention, as if such combinations had been laboriously set forth in this disclosure.

EXAMPLES

Example 1: Combining Sensors and Traffic Information for Identifying Probable Road Distress For properly identifying maneuvers on a road segment (specified by a Road ID), traffic information of the opposite lane as well as sensor-based (e.g. accelerometer) data (called road hardship cost) is used.

In the example, the traffic information is used to calculate the weighted average of hardship costs for scoring probable road distress existence on each road segment. The equation is as follows:

$$P_i = \frac{\sum_{j \in \{j | r_j = i\}} w(d_j) h_j}{\sum_{j \in \{j | r_i = i\}} w(d_j)}$$

where w is a weight function meeting $w(d_k) >= w(d_l)$ for any $d_k > d_l$, such as $w(d)=d$.

For example, the following values are assigned: Row (j)=1; Road ID (r)=123; Date Time=17:33; Road Hardship Detected (h)=0.7; Traffic in Opposite lane (d)=0.9.

Example 2: Detection of Road Distress with Fewer Samples

Use of traffic information allowed better sensitivity and specificity of automated road distress detection with fewer samples, meaning it allows detection of road distresses more quickly. The modelling enables the following with fewer samples from probe vehicles: road maintainers to identify current road distresses for focus of repairs; traffic engineers to use road distresses in their traffic models to predict and simulate traffic; route recommendation solutions to consider the road quality issues; and traffic simulators to emulate vehicle behaviors with more practical preference of road qualities taken into account.

Figure 4:
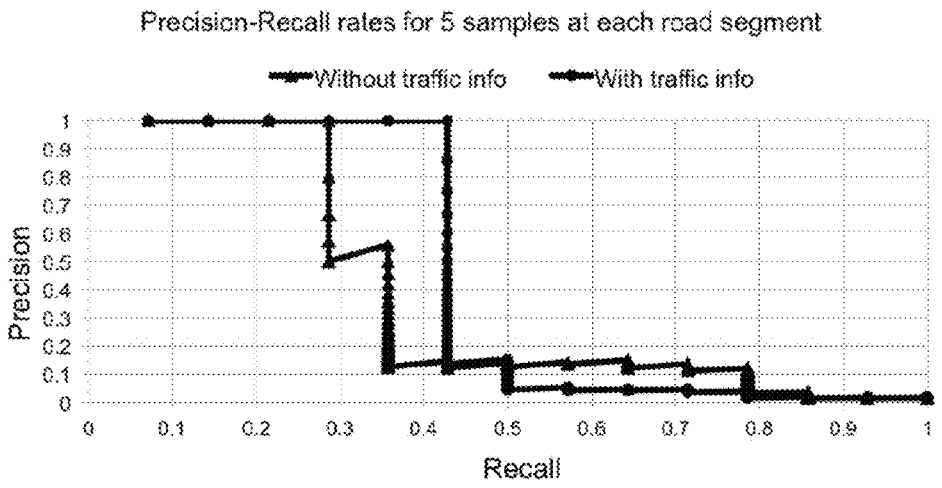
FIG. 4 provides a graph showing the accuracy of distress prediction according to an embodiment of the invention, with 5 samples per road segment.
Figure 5:
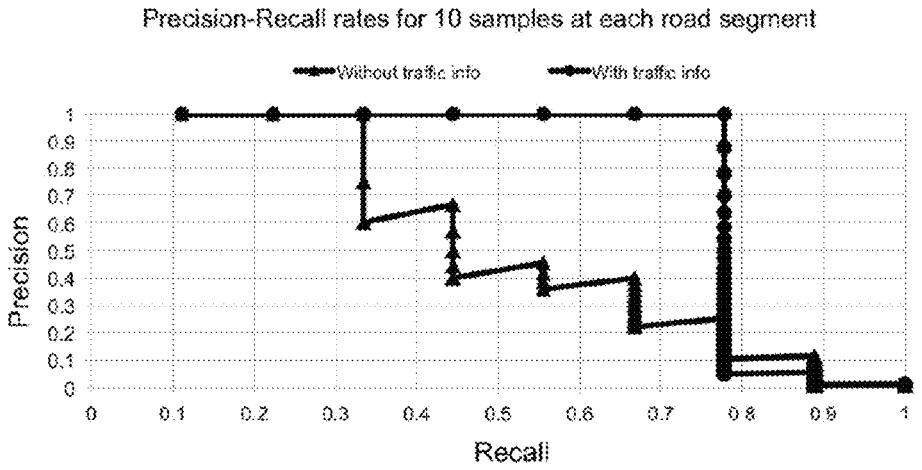
FIG. 5 provides a graph showing the accuracy of distress prediction according to an embodiment of the invention, with 10 samples per road segment.

Mostly better precision-recall rates observed at fewer samples (5 and 10 samples for each road segment) with simulated experiments, as shown in the graphs in FIG. 4 and FIG. 5.

Figure 6:
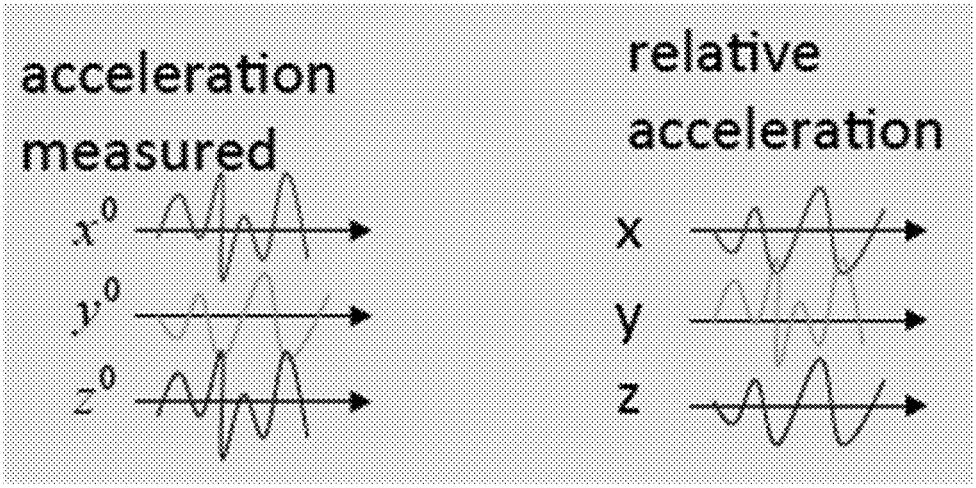
FIG. 6 provides images showing measured acceleration of a vehicle in three dimensions.

Example 3: Using Frequency Decomposition of Acceleration for Each Relative Xyz Direction of a Vehicle The sum of absolute values of acceleration for each xyz direction of a vehicle and their weighted sum is used for representing the driving "hardship" of the route or its sections. See FIG. 6 for acceleration measured and relative acceleration as recorded by accelerometers.

The hardship function for a given section of a route is (where weights can be determined through principal component analysis with training data):

$$T_{elapsed}(\Gamma_n Wn^{(x)} \Gamma W^{(x)\Gamma} \Gamma_n Wn^{(y)} \Gamma W^{(y)\Gamma} \Gamma_n Wn^{(z)} \Gamma W^{(z)\Gamma})$$

Example 4: Better Precision-Recall Rates at Fewer Samples Simulated

In 1000 road segments, 1% of the segments assigned a road distress, 20% of a time high density in the opposite lane of a target road segment, 90% of a time with actual d=1 (high density) to avoid a road distress, and 10% of a time with actual d=0 (low density) to avoid a road distress, without affecting sensors (actual h=0). A beta distribution (a=2, b=8) was assumed to simulate observed h (sensor-based road hardship) and observed d (traffic density information). For 35% recall with 5 samples, 100% precision with the invention over 55% with an ordinary method. For 80% precision with 10 samples, 78% recall with the invention over 34% with an ordinary method. See FIG. 4 and FIG. 5.

What is claimed is:

1. A method for determining the location of a road distress, comprising:

measuring, by a mobile sensor, a distress data for a road section, wherein the distress data comprises a distress time component and a distress action component;

identifying a relevant traffic data for the road section, the relevant traffic data comprising a traffic time component that corresponds to the distress time component;

calculating a probability of a road distress on the road section based on the distress data and relevant traffic data; and responsive to the calculated probability exceeding a predetermined threshold probability, generating an alert identifying the road section;

wherein:

the road distress comprises at least one of a hole, a swell, a rock, and debris;

the distress data pertains to a first lane in the road section, and the traffic data pertains to a second lane in the road section, the first lane being adjacent to the second lane;

the distress data comprises a rapid deviation in an x-y plane followed by a rapid return to an initial trajectory for a vehicle in the first lane; and the traffic data comprises a lack of any vehicles in the second lane at the traffic time component that corresponds to the distress time component.

2. The method of claim 1, wherein the mobile sensor is integral with a vehicle, or wherein the mobile sensor is integral with a mobile device, the mobile device disposed in the vehicle.

3. The method of claim 1, further comprising communicating the distress data to a remote server, via a network, and further comprising communicating the alert via a network.

4. The method of claim 1, wherein the relevant traffic data is identified from a plurality of traffic data for the road section, wherein the plurality of traffic data is indexed by a traffic time component.

5. The method of claim 1, wherein the relevant traffic data is identified from a plurality of traffic data for the road section, wherein the plurality of traffic data is indexed by a traffic time component, and wherein the method further comprises receiving, by the remote server via a network, the plurality of traffic data.

6. The method of claim 1, wherein the distress data further comprises a distress lane indicator and a distress direction component, and wherein the traffic data further comprises a traffic lane indicator and a traffic direction component.

7. The method of claim 1, wherein the probability is determined by a remote server, and wherein the remote server receives a plurality of distress data from the mobile sensor, and wherein the method further comprises identifying a relevant distress action in the distress data.

8. The method of claim 1, wherein the mobile sensor is integral with a vehicle, or wherein the mobile sensor is integral with a mobile device, the mobile device disposed in the vehicle, and wherein the relevant traffic data is identified from a plurality of traffic data for the road section, wherein the plurality of traffic data is indexed by a traffic time component.

9. The method of claim 1, wherein the alert is configured to initiate a road distress avoidance measure in a vehicle.

10. The method of claim 1, wherein the alert is a machine-readable instruction configured to initiate a road distress avoidance measure in a vehicle when the vehicle enters the identified road section, and wherein the method further comprises adding the alert to a database of alerts.

11. A computer system for determining the location of a road distress, comprising:

a processor;

a memory coupled to the processor, the memory configured to store program instructions executable by the processor to cause the computer system to:

receive, from a mobile sensor, a distress data for a road section, wherein the distress data comprises a distress time component and a distress action component;

identify a relevant traffic data for the road section, the relevant traffic data comprising a traffic time component that corresponds to the distress time component;

calculate a probability of a road distress on the road section based on the distress data and relevant traffic data; and responsive to the calculated probability exceeding a predetermined threshold probability, generate an alert identifying the road section;

wherein:

the road distress comprises at least one of a hole, a swell, a rock, and debris;

the distress data pertains to a first lane in the road section, and the traffic data pertains to a second lane in the road section, the first lane being adjacent to the second lane;

the distress data comprises a rapid deviation in an x-y plane followed by a rapid return to an initial trajectory for a vehicle in the first lane; and the traffic data comprises a lack of any vehicles in the second lane at the traffic time component that corresponds to the distress time component.

12. The computer system of claim 11, wherein the relevant traffic data is identified from a plurality of traffic data for the road section, wherein the plurality of traffic data is indexed by a traffic time component.

13. The computer system of claim 11, wherein the mobile sensor is integral with a vehicle, or wherein the mobile sensor is integral with a mobile device, the mobile device disposed in the vehicle.

14. The computer system of claim 11, wherein the mobile sensor is integral with a vehicle, or wherein the mobile sensor is integral with a mobile device, the mobile device disposed in the vehicle, and wherein the relevant traffic data is identified from a plurality of traffic data for the road section, wherein the plurality of traffic data is indexed by a traffic time component.

15. The computer system of claim 11, wherein the alert is configured to initiate a road distress avoidance measure in a vehicle.

16. The computer system of claim 11, wherein the alert is a machine-readable instruction configured to initiate a road distress avoidance measure in a vehicle when the vehicle enters the identified road section, and wherein the method further comprises adding the alert to a database of alerts.

17. A method for managing road repair resources, the method comprising:

calculating a probability of a road distress in a road section by combining sensor data from a mobile sensor with relevant traffic data; and automatically alerting a road repair resource to request repair of the road section when the calculated probability of a road distress exceeds a predetermined threshold probability.

18. The method of claim 17, wherein the sensor data pertains to a first lane in the road section, and wherein the traffic data pertains to a second lane in the road section, the first lane being adjacent to the second lane.

19. The method of claim 17, wherein the distress data pertains to a first lane in the road section, and wherein the traffic data pertains to a second lane in the road section, the first lane being adjacent to the second lane, and wherein the relevant traffic data is identified from a plurality of traffic data for the road section, wherein the plurality of traffic data is indexed by a traffic time component.

20. The method of claim 17, wherein the mobile sensor is integral with a vehicle, or wherein the mobile sensor is integral with a mobile device, the mobile device disposed in the vehicle, and wherein the relevant traffic data is identified from a plurality of traffic data for the road section, wherein the plurality of traffic data is indexed by a traffic time component.

* * * * *